United States Patent [19]

Tommaney et al.

[11] 4,161,399

[45] Jul. 17, 1979

[54] METHOD FOR ELECTROSLAG REMELTING OF A MANGANESE-COPPER-NICKEL ALLOY

[75] Inventors: Joseph W. Tommaney, Sarver, Pa.; Claudia J. Burton, Clinton, N.Y.

[73] Assignee: Allegheny Ludlum Industries, Inc., Pittsburgh, Pa.

[21] Appl. No.: 904,165

[22] Filed: May 8, 1978

[51] Int. Cl.[2] ..... C22B 4/06

[52] U.S. Cl. ..... 75/10 C; 75/10 R; 75/53; 75/159; 75/161; 75/257

[58] Field of Search ..... 75/257, 10 R, 10 C, 75/53, 159, 161

[56] References Cited

U.S. PATENT DOCUMENTS

| | | | |
|---|---|---|---|
| 3,849,211 | 11/1974 | Gurevich | 75/257 |
| 3,879,192 | 4/1975 | Segawa | 75/257 |

FOREIGN PATENT DOCUMENTS

| | | | |
|---|---|---|---|
| 979583 | 1/1965 | United Kingdom | 75/10 R |

*Primary Examiner*—P. D. Rosenberg

*Attorney, Agent, or Firm*—Vincent G. Gioia; William J. O'Rourke, Jr.

[57] ABSTRACT

A manganese-copper-nickel alloy is remelted to form high quality ingots or slabs which are capable of undergoing hot-working in the "as cast" form by electroslag remelting the alloy under a flux composition prepared by fusing a mixture consisting essentially of from about 50% to about 85% barium fluoride and from about 15% to about 50% calcium fluoride, by weight.

14 Claims, No Drawings

METHOD FOR ELECTROSLAG REMELTING OF A MANGANESE-COPPER-NICKEL ALLOY

This invention relates to an improved method for the electroslag remelting of a manganese-copper-nickel alloy whereby ingots characterized by both a good surface condition and good internal quality are produced. More particularly, this invention relates to a method for the production of large diameter ingots of such an alloy.

Generally, in the electroslag remelting of a metal, an electrode of the metal is partially immersed in a slag contained in a cooled mold and the slag is heated to a temperature above the melting point of the metal by the slag's resistance to an electric current passed between the baseplate of the mold and the electrode. Preferably, the slag becomes a molten bath at a temperature below the metal's melting point so that as the metal melts, droplets of the molten metal fall through the slag bath to collect in a pool over the cooled baseplate and solidify. Descriptions of the process are given in U.S. Pat. Nos. 2,694,023; 3,067,473, 2,868,681, 3,551,137 and in the Duckworth and Hoyle text, "Electroslag Refining," Chapman and Hall, Ltd. (London, 1969).

The electroslag remelting (ESR) method is not known to have been successful heretofore in the production of manganese-copper-nickel alloy ingots having a cross section greater than 20 inches. A successful ESR method must produce an ingot having a smooth surface so that it may be hot-worked in the "as cast" form. This precludes any surface preparation of the ingot after casting. Another requirement is that the internal structure of the ingot must be free of entrapped slag, voids, macro segregation and other defects which would make the ingot unsuitable for its many applications. It is recognized that there may never be a casting method which is completely successful within the purview of these and other constraints but to the degree that a method approaches that goal, the yield of good material approaches economic acceptability.

The surface condition and internal quality of an ingot may be controlled individually by adjusting the rate of melting but the one characteristic will benefit at the expense of the other. When ingots of the contemplated Mn—Cu—Ni alloy are melted under a slag of the prior art at about 3000 to 3600 pounds per hour, the surface condition is better than when the rate is about 750–1000 pounds per hour. Segregation and pipe in the ingot melted at the high rate, however, are unacceptable whereas these internal conditions are improved when a low rate of melting is employed.

Moreover, as the size of the ingot increases the tendency toward segregation and pipe also increases. Also, increasing the ingot diameter while holding the melt rate constant normally produces a poorer surface condition.

An early patent is the field of manganese-copper-nickel alloys, U.S. Pat. No. 2,287,888, taught the use of slags containing manganese chloride, manganese oxide and alkaline earth metal halides as fluxes to protect the molten alloy from the air. This patent issued long before electroslag remelting was contemplated in the metal refining art.

Since the genesis of electroslag refining, however, there have been many attempted improvements in the composition of the ESR slags used in the production of high quality steels and of non-ferrous metals.

An ESR flux composition containing alumina, a fluoride and an alkaline earth metal oxide is taught in U.S. Pat. No. 3,857,702. Calcium fluoride is preferred by the patentee but magnesium, barium and strontium fluorides as well as others which are stable at temperatures over 900° F. are taught as being suitable.

The production of high quality non-ferrous ingots by an ESR process employing a slag comprising a mixture of oxygen-free halides of alkali and alkaline earth metals is taught in British Pat. No. 1,175,453. For melting nickel, the patentees teach the use of a slag containing 70–90% calcium fluoride and 10–30% barium chloride or one in which from 10 to 20% of the calcium fluoride is replaced by barium oxide. For melting copper, the slag contains 50–80% calcium fluoride and 20–50% barium chloride. The utility of the slag is demonstrated by the production of a small ingot of nickel having a diameter of about 5 inches (130mm).

According to U.S. Pat. No. 3,879,192, an ESR slag for the production of high quality steels, nickel alloys, chromium alloys and the like is required to contain at least 0.5% of at least one metallic element selected from among metallic calcium, strntium, magnesium and barium. The remainder of the slag is taught to be essentially composed of calcium fluoride, strontium fluoride, magnesium fluoride, or barium fluoride or mixtures thereof. A protective atmosphere of argon, helium, or nitrogen or a mixture of said gases is taught to be required during the remelting of the metal. Steel ingots having a diameter of about 3 inches (70mm) are produced by the method as exemplified in the patent. Aluminum is rejected by the patentees as a component of the slag.

However, it has now been discovered that the alkaline earth metal fluorides are not equivalent as components of an ESR flux. A commercial flux consisting of the fluorides of calcium, magnesium and barium is wholy unsatisfactory in the ESR casting of large diameter ingots of the manganese-copper-nickel alloy contemplated for the purpose of this invention.

It is, therefore, an object of this invention to provide a melting technique capable of producing high quality electroslag melted ingots or slabs of a manganese-copper-nickel alloy in sizes of about 20 inches or more in diameter or equivalent cross section.

It is also an object of this invention to provide a method for the production of such an ingot which may be hot-worked in the "as cast" form because of its smooth surface and its freedom from entrapped slag, voids and segregation.

It is a further object of this invention to provide large diameter ingots of such an alloy having both a good surface condition and a superior internal condition.

It is a still further object of this invention to provide an ESR flux composition which is stable at the operating temperatures so that volatile decomposition products are not formed during use.

These objects are achieved by a method for the electroslag remelting of a manganese-copper-nickel alloy, which method comprises preparing a mixture consisting essentially of from about 50% to about 85% barium fluoride and from about 15% to about 50% calcium fluoride, by weight, fusing said mixture at a temperature within the range of from about 200° F. below the melting point of the alloy to about 100° F. above the melting point of said alloy to form a flux composition, placing said flux composition in an electroslag remelting mold, inserting a portion of said alloy in said flux composition, generating sufficient Joule heat in said flux composition to said alloy by passing an electric current between the alloy and the mold whereby molten alloy falls through the flux and collects at the bottom of the mold where, upon cooling, the alloy solidifies.

The rate of remelting of the alloy is determined by the amount of Joule heat generated in the flux and this, in turn, is determined by the amperage of the electric current. For the preparation of small diameter ingots (e.g., about 4 inches) the rate may be from about 100 to about 250 or more pounds per hour. Large diameter ingots (e.g., about 24 inches) are preferably prepared at a melting rate of from about 750 to about 1250 pounds per hour, but a lower rate as well as a rate of 1500 pounds or more may be used.

Either AC or DC current may be used. When DC current is used the alloy may serve as either the cathode or anode and the base plate of the mold serves as the other electrode; thus either straight or reverse polarity may be established.

The melting of the alloy may be carried out in contact with air or under a protective atmosphere of an inert gas such as argon, helium, nitrogen or mixtures thereof.

In the event that the alloy has a high oxygen content before remelting or contact with air during remelting will cause a high oxygen content in the ingot, deoxidation by the addition of aluminum metal to the liquid slag during the remelting operation is contemplated. Calcium oxide may be added along with the aluminum metal if necessary.

The utility of the flux composition of this invention is based on the coincident of desirable properties manifested by the composition when employed in the method as described above.

The liquidus temperature, resistivity, fluidity and stability of the flux composition of this invention are all contributing factors in the production of ingots and slabs which may be hot-worked in the "as-cast" form.

A particularly preferred composition is obtained by the fusion of a mixture consisting essentially of about 70% barium fluoride and about 30% calcium fluoride, by weight. A flux prepared by fusing a 50:50 mixture of barium fluoride and calcium fluoride is useful in the production of small diameter ingots.

The flux may be prepared by mixing the two fluorides, fusing the mixture and then cooling the fused material and crushing the resulting solid. Preferably, the fused material is poured as a liquid into the electroslag mold so that the alloy, serving as an electrode, may be immersed directly into the flux and resistance heating of the flux toward the melting temperature of the alloy may be started.

The manganese-copper-alloy has the nominal composition of from about 69 to about 77% manganese, from about 11 to about 24% copper and from about 5 to about 15% nickel, by weight. Preferably, the alloy will be composed of from about 71 to about 73% manganese, from about 17 to about 19% copper and from about 9 to about 11% nickel. Only incidental trace amounts of other elements are contemplated as components of the alloy.

The slag composition employed in the method of this invention was compared with two different compositions taught by the Duckwork and Hoyle text referred to hereinabove. A program of nine heats consisting of 3 heats under each slag at different melting rates was carried out. In each heat, a vacuum induction molded electrode nominally consisting of 72 wt.% manganese, 18 wt.% copper, and 10 wt.% nickel and having a diameter of 2½ inches is electroslag remelted to form an ingot having a 4 inch diameter. The slag compositions and other conditions for each heat are indicated in Table I.

TABLE I

| Heat No. | Slag Composition* | Slag Volume | Melt Rate*** | Additions |
|---|---|---|---|---|
| A-1 | A | 2 pounds | Low | None |
| A-2 | | 3 pounds | Medium | Al |
| A-3 | | 4 pounds | High | Al + CaO |
| B-1 | B | 4 pounds | Low | Al |
| B-2 | | 2 pounds | Medium | Al + CaO |
| B-3 | | 3 pounds | High | None |
| C-1 | C | 3 pounds | Low | Al + CaO |
| C-2 | | 4 pounds | Medium | None |
| C-3 | | 2 pounds | High | Al |

*Slag A is 70% $BaF_2$ + 15% $CaF_2$ + 15% $MgF_2$
Slag B is 50% $BaF_2$ + 50% $CaF_2$
Slag C is 80% $CaF_2$ + 20% $MgF_2$
***Low is about 100–200 lbs/hr. (~2000 amps)
Medium is about 120–180 lbs/hr. (~3300 amps)
High is about 180–250 lbs/hr. (~4500 amps)

Each ingot was inspected by three observers and rated on a scale of 0 to 10 (0 being poorest) for its surface condition and internal structure. The average ratings are given in Table II.

TABLE II

| Heat No. | Surface Condition | Internal Structure |
|---|---|---|
| A-1 | 1.3 | 6.0 |
| A-2 | 3.0 | 2.3 |
| A-3 | 3.7 | 1.8 |
| B-1 | 8.0 | 9.0 |
| B-2 | 10.0 | 9.0 |
| B-3 | 9.3 | 1.0 |
| C-1 | 1.7 | 9.0 |
| C-2 | 8.0 | 3.0 |
| C-3 | 7.7 | 3.5 |

It will be apparent from Table II that slag composition B, employed in the method of this invention, gives superior results in that both the surface condition and internal structure of the ingots prepared under such a slag have high ratings under all conditions except in Heat No. B-3 in which a high melting rate is employed in the absence of aluminum as a deoxidizer.

The advantages of the invention are shown further by the excellent surface condition and internal structure of large diameter ingots under a flux composition prepared by fusing a mixture of about 70% barium fluoride and about 30% calcium fluoride at a melt rate of about 1200 pounds per hour. Only small portions of the ingots had to be scrapped before they were hot-rolled into coils of the alloy.

Whereas the above description of the method of this invention sets forth one embodiment of the flux composition of the invention, the amounts of barium fluoride and calcium fluoride in the mixture to be fused to form the flux composition of this invention are not restricted to those given in said description. The flux composition of this invention, in its broader scope, is formed by fusing a mixture consisting essentially of from about 35% to about 85% barium fluoride and from about 15% to about 65% calcium fluoride, by weight. A flux composition prepared from a mixture of from about 35% to about 75% barium fluoride and from about 25% to about 65% calcium fluoride is another embodiment of the composition of this invention. This composition has particular utility in the electroslag remelting of copper-nickel alloys as disclosed in our co-pending application entitled "Method for Electroslag Remelting of a Copper-Nickel Alloy" filed of even date herewith and commonly assigned. Said application is incorporated by reference herein for its teaching of the further utility of the flux composition of this invention.

Having described the invention with the understanding that modifications and variations of the method may be employed without departing from the spirit and scope of the invention, we claim:

1. A method for the electroslag remelting of a manganese-copper-nickel alloy, which method comprises preparing a mixture consisting essentially of from about 50% to about 85% barium fluoride and from about 15% to about 50% calcium fluoride, by weight, fusing said mixture at a temperature within the range of from about 100° F. below the melting point of the alloy to about 100° F. above said melting point to form a flux composition, placing said flux composition in an electroslag remelting mold, inserting said alloy into said flux composition, generating sufficient Joule heat in said flux composition to melt said alloy by passing electric current between said mold and said alloy so that the molten alloy falls through the flux, collecting said molten alloy and cooling it to a temperature below its melting point.

2. A method for the electroslag remelting of a manganese-copper-nickel alloy, which method comprises placing in an electroslag remelting mold a mixture consisting essentially of from about 50% to about 85% barium fluoride and from about 15% to about 50% calcium fluoride, by weight, inserting the alloy into said mixture, passing electric current between said mold and the alloy to fuse said mixture, thereby forming a flux composition having a liquidus temperature within the range of from about 100° F. below the melting point of the alloy to about 100° F. above said melting point, and to generate sufficient Joule heat in said flux composition to melt said alloy, collecting the molten alloy and cooling it to a temperature below its melting point.

3. The method of claim 1 wherein the alloy consists essentially of from about 69% to about 77% manganese, from about 11% to about 24% copper, and from about 5% to about 15% nickel, by weight.

4. The method of claim 1 wherein the mixture consists essentially of about 70% barium fluoride and about 30% calcium fluoride.

5. The method of claim 1 wherein the electric current is sufficient to melt the alloy at a rate of from about 750 to about 1250 pounds per hour.

6. The method of claim 1 wherein the mixture is fused at a temperature of about 100° F. below the melting point of the alloy.

7. An electroslag remelting flux composition formed by the fusion of a mixture consisting essentially of from about 35% to about 85% barium fluoride and from about 15% to about 65% calcium fluoride, by weight.

8. The composition of claim 7 wherein the barium fluoride and calcium fluoride constitute about 70% and about 30%, weight, respectively, of the mixture.

9. The composition of claim 7 further characterized by a liquidus temperature of from about 1850° F. to about 2100° F.

10. An ingot of an alloy consisting, by weight, essentially of from about 71% to about 73% manganese, from about 17% to about 19% copper, and from about 9% to about 11% nickel, electroslag remelted in a flux composition consisting essentially of from about 50% to about 85% barium fluoride and from about 15% to about 50% calcium fluoride, by weight said ingot having a cross section greater than 20 inches and being capable of undergoing hot working operations in its "as cast" form.

11. An electroslag-remelted ingot of an alloy consisting, by weight, essentially of from about 71% to about 73% manganese, from about 17% to about 19% copper, and from about 9% to about 11% nickel, said ingot being prepared by the method of claim 1.

12. The composition of claim 7 wherein the barium fluoride and calcium fluoride constitute from about 50% to about 85% and from about 15% to about 50%, by weight, respectively, of the mixture.

13. The method of claim 2 characterized further by the addition of a deoxidizing amount of aluminum to the flux composition during the melting of the alloy while maintaining the liquidus temperature within the given range.

14. The method of claim 13 wherein said liquidus temperature is maintained by the addition of a sufficient amount of calcium oxide to the flux composition during the melting of the alloy.

* * * * *